US005601441A

United States Patent [19]

Weinstein et al.

[11] Patent Number: 5,601,441

[45] Date of Patent: Feb. 11, 1997

[54] SELF-TERMINATING ELECTRICAL CONNECTOR

[75] Inventors: David Weinstein, Yorktown Heights; Gino Antonini, Pelham, both of N.Y.

[73] Assignee: Kings Electronics Co., Inc., Tuckahoe, N.Y.

[21] Appl. No.: 521,550

[22] Filed: Aug. 30, 1995

[51] Int. Cl.[6] ..... H01R 29/00

[52] U.S. Cl. ..... 439/188

[58] Field of Search ..... 439/188, 578, 439/944, 579–85

[56] References Cited

U.S. PATENT DOCUMENTS 3,873,785 3/1975 Lieberman ..... 439/944

4,971,569 11/1990 Gooch et al. ..... 439/188

*Primary Examiner*—Gary F. Paumen

*Assistant Examiner*—Christopher Goins

*Attorney, Agent, or Firm*—Bierman and Muserlian

[57] ABSTRACT

A printed circuit board receptacle connector that terminates itself in its characteristic impedance when a mating plug is disengaged therefrom.

3 Claims, 1 Drawing Sheet

SELF-TERMINATING ELECTRICAL CONNECTOR

The present invention is directed to a self-terminating electrical connector, and more specifically to a self-terminating printed circuit board receptacle that will terminate itself in its characteristic impedance when a mating plug is disengaged therefrom.

BACKGROUND OF THE INVENTION

As the frequencies, clock speeds, and data rates increase in the field of telecommunications, it is no longer acceptable to allow the output port of a printed circuit board (pcb) receptacle connector to remain unterminated. The presence of an unterminated connector allows signals to radiate therefrom, causing interference in other circuits within the device. Previous practice entailed termination of the pcb connector with an external termination. This technique was expensive, required stocking of additional inventory, was time-consuming and could be neglected. Therefore, it was determined that the availability of a self-terminating connector would be advantageous.

BRIEF DESCRIPTION OF THE INVENTION

In view of the foregoing, it is an object of the present invention to provide a receptacle connector that will terminate itself in its characteristic impedance when a mating plug is disengaged therefrom.

Other objects and features of the present invention will become apparent from the following detailed description considered in conjunction with the accompanying drawings.

DETAILED DESCRIPTION OF THE INVENTION

Figure 1:
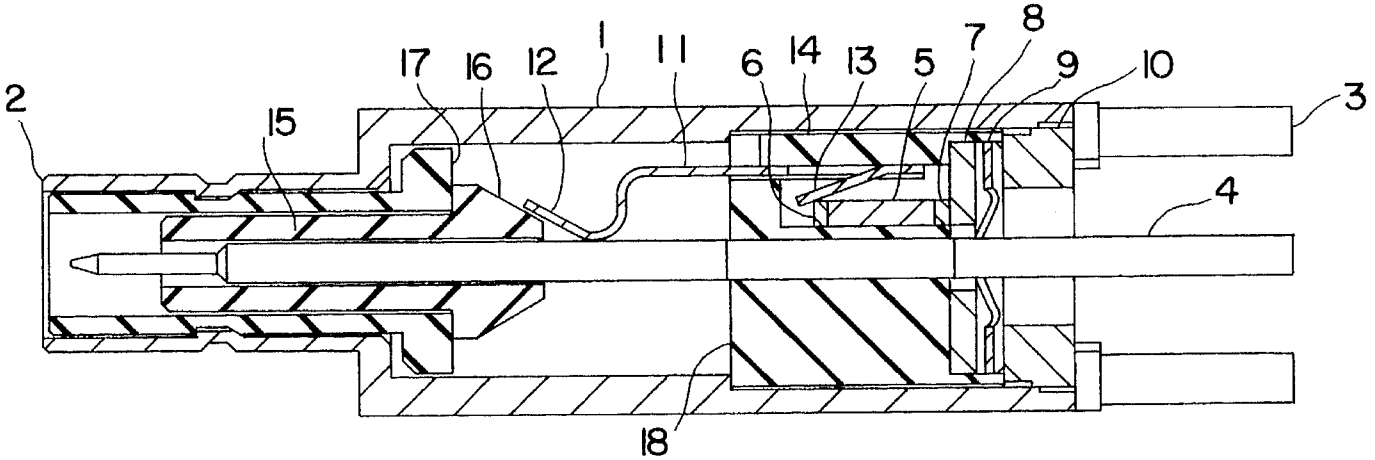
FIG. 1 is a cross-sectional view of the inventive self-terminating circuit board receptacle in the unmated/terminated position.

Referring to FIG. 1, there is shown the inventive self-terminating electrical connector adapted to conduct an electrical signal when mated to mating connector, and terminate said signal by providing an appropriate impedance upon disengagement of the mating connector. The inventive connector comprises connector body 1 having front body face 2 formed as a connector port, and rear body face 3 being adapted to connect to a coaxial signal source. Mounted coaxially within, and electrically isolated from conductor body 1 by insulator 14, there is provided center conductor 4. Terminating resistor 5 having a first resistor face 6 and a second resistor face 7 is mounted within connector body 1. Second resistor face 7 is maintained in conductive contact with connector body 1, preferably through washer 8 and wave washer 9. Wave washer 9 compensates for tolerance buildup, and can be held in place by cap 10.

In conductive contact with first resistor face 6, there is provided conductive spring 11 having first spring end 12 and second spring end 13. Conductive spring 11 maintains conductive contact with first resistor face 6 through second spring end 13. First spring end 12 is provided with a sloped surface and is movable between a first spring position, in which first spring end 12 is in conductive contact with center conductor 4, and a second spring position, in which contact between first spring end 12 and center conductor 4 is interrupted.

Coaxially mounted on center conductor 4, proximal to front body face 2, there is further provided slidable plunger 15, formed of an insulative material. Plunger 15 is formed with sloped mating surface 16 which mates with first spring end 12. Plunger 15 is slidably movable, against the force of conductive spring 11, between a forward position and a rearward position, movement of plunger 15 being limited in the forward direction by a first stop that can comprise shoulder 17, and, in a rearward direction by the length of mating plug insulator.

Figure 2:
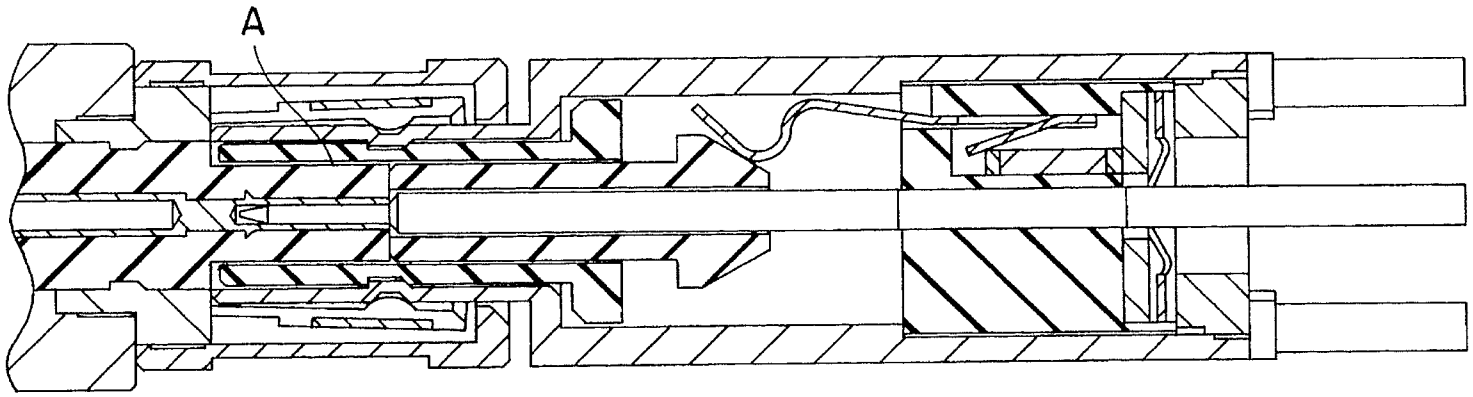
FIG. 2 is a cross-sectional view of the inventive receptacle connector mated with a mating plug, and in the unterminated mode.

As shown in FIG. 2, insertion of a mating connector A into connector body 1 through front body face 2 causes electrical contact between connector body 1 and the mating connector body of the mating connector, as well as between center conductor 4, and the mating center conductor of the mating conductor. Insertion further causes rearward movement of plunger 15, whereby sloped mating surface 16 forces first spring end 12 to the second spring position wherein contact between first spring end 12 and center conductor 4 is interrupted.

Withdrawal of mating connector A from first body face 2 of connector body 1 interrupts electrical contact between connector body 1 and the mating connector body, and between center conductor 4 and the mating center conductor. Withdrawal further allows forward movement of plunger 15 under force of conductive spring 11, to the forward position, whereby sloped mating surface 16 withdraws and allows movement of first spring end 12 to the first spring position in which contact between first spring end 12 and center conductor 4 is re-established. When rear body face 3 is connected to the coaxial power source, an impedance signal is thereby established between connector body 1 and center conductor 4 thus eliminating all signals emanating from the receptacle connector.

While only fundamental novel features of the invention, as applied to a preferred embodiment thereof, specifically, a pcb connector have been expressly described, it is understood that the invention is adaptable for use with all types and series of connectors, and that various omissions, substitutions, and changes in the form and details of the device illustrated, and in its operation, may be made by those skilled in the art without departing from the spirit of the invention. It is therefore the intention of Applicants that the invention be limited only as indicated by the scope of the claims appended hereto.

We claim:

1. A self-terminating electrical connector adapted to conduct an electrical signal when mated to a mating connector, said mating connector having a mating connector body and a mating center conductor, and terminate said signal by providing an appropriate impedance upon disengagement of said mating connector, said electrical connector comprising:

a connector body having a front body face formed as a connector port, and a rear body face, said rear body face being adapted to connect to a coaxial signal source;

a center conductor coaxially mounted within, and electrically isolated from, said connector body;

a terminating resistor having a first resistor face and a second resistor face, said second resistor face being in conductive contact with said connector body;

a conductive spring having a first spring end and a second spring end, said second spring end being in conductive contact with said first resistor face; said first spring end having a sloped surface movable between a first spring position, in which said first spring end is in conductive contact with said center conductor, and a second spring position, in which contact between said first spring end and said center conductor is interrupted; and a slidable plunger formed of an insulative material, coaxially mounted on said center conductor proximal to said front body face, said plunger having a sloped mating surface adapted to mate with said first spring end, said plunger being movable against force of said conductive spring, between a forward position and a rearward position, forward movement of said plunger being limited by a stop;

whereby insertion of a mating connector into said front body face of said connector body causes electrical contact between said connector body and a mating connector body of said mating connector, and between said center conductor and a mating center conductor of said mating connector, said insertion further causing rearward movement of said plunger, whereby said sloped mating surface forces movement of said first spring end to said second spring position, whereby contact between said first spring end and said center conductor is interrupted; and withdrawal of said mating connector from said front body face of said connector body interrupts electrical contact between said connector body and said mating connector body, and between said center conductor and said mating center conductor, said withdrawal further allowing for forward movement of said plunger under force of said conductive spring, to a forward position, whereby said sloped mating surface of said plunger allows movement of said first spring end to said first spring position due to mating between said sloped mating surface of said plunger and said first spring end, wherein contact between said first spring end and said center conductor is re-established and, when said rear body face is connected to said coaxial power source, an impedance is established between said connector body and said center conductor through said resistor and said conductive spring.

2. The electrical connector of claim 1 wherein said connector is a printed circuit board receptacle connector.

3. The electrical connector of claim 1 wherein said connector is a 75 ohm printed circuit board receptacle.

* * * * *